US005454623A

United States Patent [19]

Parks

[11] Patent Number: 5,454,623

[45] Date of Patent: Oct. 3, 1995

[54] BACK REST FOR USE IN RESTING AGAINST A TREE

[76] Inventor: William R. Parks, R.D. 1, Box 181, New Ringgold, Pa. 17960

[21] Appl. No.: 285,138

[22] Filed: Aug. 3, 1994

[51] Int. Cl.[6] ..... A47C 7/02

[52] U.S. Cl. ..... 297/230.1; 297/4; 297/452.46

[58] Field of Search ..... 297/230.1, 230.12, 297/4, 452.46, 129

[56] References Cited

U.S. PATENT DOCUMENTS

| | | | |
|---|---|---|---|
| 1,419,006 | 6/1922 | Barrett | 297/230.1 |
| 3,138,404 | 6/1964 | Newton | 297/452.46 X |
| 4,025,105 | 5/1977 | Pekala | 297/4 |
| 4,394,783 | 7/1983 | Simmons | 297/230.1 |
| 5,271,659 | 12/1993 | Zinkevicz | 297/4 |

*Primary Examiner*—Laurie K. Cranmer

[57] ABSTRACT

A back rest for use in resting against a tree comprising a pad of a generally trapezoidal configuration with a front face and a rear face and formed of a resilient elastomeric material, the pad being wider at its top edge than its bottom edge, the pad having a plurality of apertures in rows and columns throughout the majority of its extent, a projection extending rearwardly from the rear face of the pad adjacent to its top edge, the projection having a concave surface adapted to be received by the convex surface of a tree against which the pad is positioned and a plurality of belt loops formed adjacent to the top edge of the device with the holes of the loops in axially alignment for being supported on the belt of a user.

4 Claims, 4 Drawing Sheets

BACK REST FOR USE IN RESTING AGAINST A TREE

BACKGROUND OF THE INVENTION

1. Field of the Invention

The present invention relates to back rest for use in resting against a tree and more particularly pertains to providing comfortable rest to hunters, campers, hikers and the like through a back rest to be worn when leaning with one's back against a tree.

2. Description of the Prior Art

The use of pads, cushions and other devices for use in resting is known in the prior art. More specifically, pads, cushions and other devices for use in resting heretofore devised and utilized for the purpose of providing soft surfaces of various designs and constructions against which a user may rest are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. DES. 249,217 to Pierce discloses a portable back rest or similar article.

U.S. Pat. No. Des. 261,084 to Scott discloses a portable back rest.

U.S. Pat. No. 4,502,728 to Sheldon discloses a portable seat and back rest.

U.S. Pat. No. 5,022,622 to Schaevitz discloses a support for the body of a worker.

U.S. Pat. No. 5,060,754 to Feick discloses a standing position back support.

In this respect, the back rest for use in resting against a tree according to the present invention substantially departs from the conventional concepts and designs of the prior art, and in so doing provides an apparatus primarily developed for the purpose of providing comfortable rest to hunters, campers, hikers and the like through a back rest to be worn when leaning with one's back against a tree.

Therefore, it can be appreciated that there exists a continuing need for new and improved back rest for use in resting against a tree which can be used for providing comfortable rest to hunters, campers, hikers and the like through a back rest to be worn when leaning with one's back against a tree. In this regard, the present invention substantially fulfills this need.

SUMMARY OF THE INVENTION

In view of the foregoing disadvantages inherent in the known types of pads, cushions and other devices used for resting now present in the prior art, the present invention provides an improved back rest for use in resting against a tree. As such, the general purpose of the present invention, which will be described subsequently in greater detail, is to provide a new and improved back rest for use in resting against a tree through an apparatus and method which has all the advantages of the prior art and none of the disadvantages.

To attain this, the present invention essentially comprises a new and improved back rest for use in resting against a tree comprising, in combination a pad of a generally trapezoidal configuration with a front face and a rear face and formed of a resilient elastomeric material, the pad being about 24 inches in height, about 13 inches in width at its bottom edge, and, about 17 inches in width at its top edge, the pad having a plurality of rectangular apertures in rows and columns throughout the majority of its extent, a projection extending rearwardly from the rear face of the pad adjacent to its top edge, the projection having a concave surface adapted to be received by the convex surface of a tree against which the pad is positioned. A plurality of belt loops formed adjacent to the top edge of the device with the holes of the loops in axially alignment for being supported on the belt of a user; a plurality of eyelets secured with respect to the front face of the pad, the eyelets being positioned adjacent to the four corners of the pad; and a pair of shoulder straps, each shoulder strap having a hook at its opposite ends for securement with vertically aligned eyelets of the pad, each strap having an adjustment means intermediate its end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved back rest for use in resting against a tree which has all the advantages of the prior art pads, cushions and other devices used for resting and none of the disadvantages.

It is another object of the present invention to provide a new and improved back rest for use in resting against a tree which may be easily and efficiently manufactured and marketed.

It is a further object of the present invention to provide a new and improved back rest for use in resting against a tree which is of a durable and reliable construction.

An even further object of the present invention is to provide a new and improved back rest for use in resting against a tree which is susceptible of a low cost of manufacture with regard to both materials and labor, and which accordingly is then susceptible of low prices of sale to the consuming public, thereby making such pads, cushions and other devices used for resting economically available to the buying public.

Still yet another object of the present invention is to provide a new and improved back rest for use in resting against a tree which provides in the apparatuses and methods of the prior art some of the advantages thereof, while simultaneously overcoming some of the disadvantages normally associated therewith.

Still another object of the present invention is to provide comfortable rest to hunters, campers, hikers and the like through a back rest to be worn when leaning with one's back against a tree.

Lastly, it is an object of the present invention to provide new and improved back rest for use in resting against a tree comprising a pad of a generally trapezoidal configuration with a front face and a rear face and formed of a resilient elastomeric material, the pad being wider at its top edge than its bottom edge, the pad having a plurality of apertures in rows and columns throughout the majority of its extent, a projection extending rearwardly from the rear face of the pad adjacent to its top edge, the projection having a concave surface adapted to be received by the convex surface of a tree against which the pad is positioned and a plurality of belt loops formed adjacent to the top edge of the device with the holes of the loops in axially alignment for being supported on the belt of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numeral refers to the same part throughout the various figures.

DESCRIPTION OF THE PREFERRED EMBODIMENT

Figure 1:
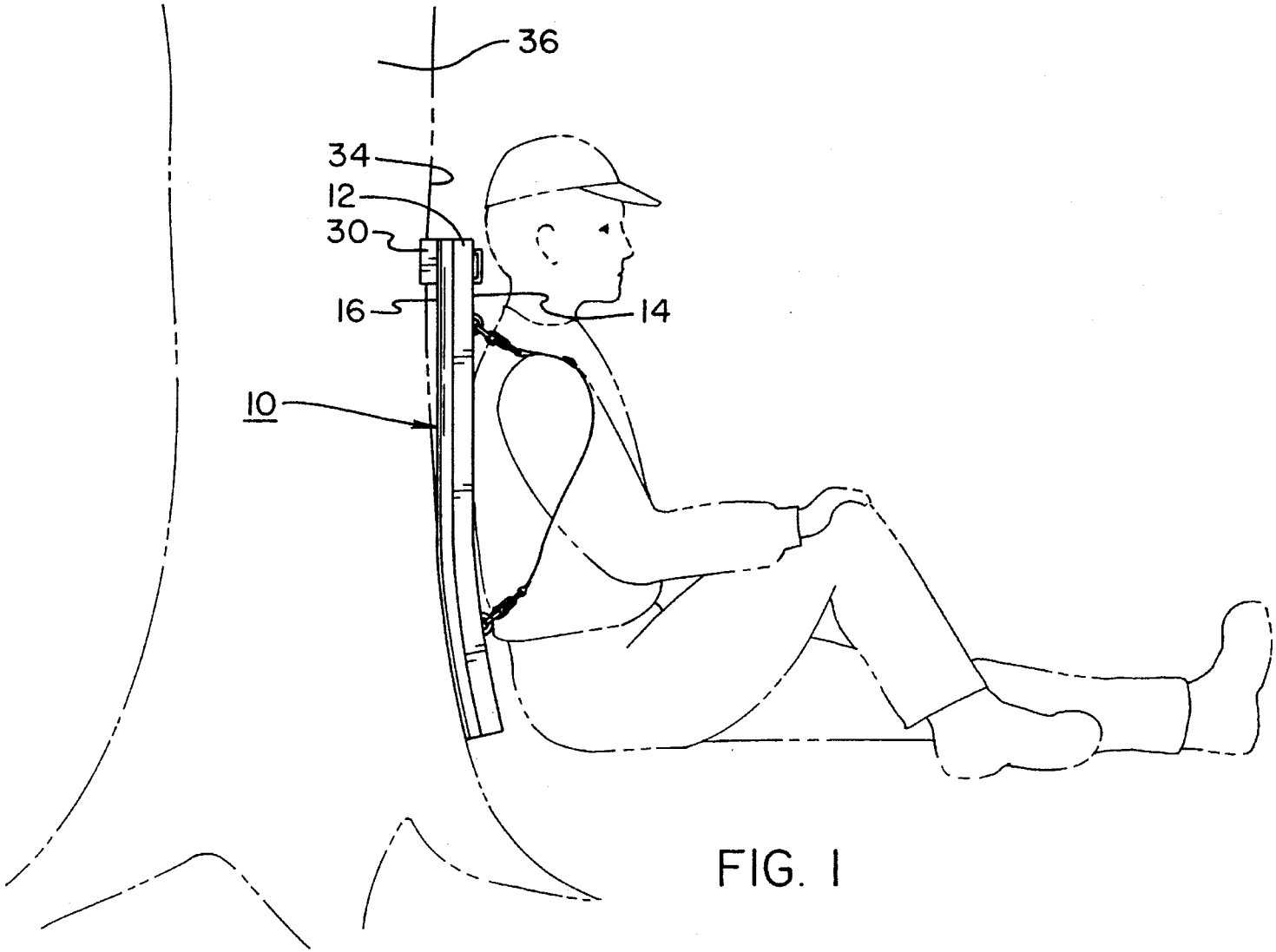
FIG. 1 is a side elevational view of the preferred embodiment of the new and improved back rest for use in resting against a tree constructed in accordance with the principals of the present invention.
Figure 2:
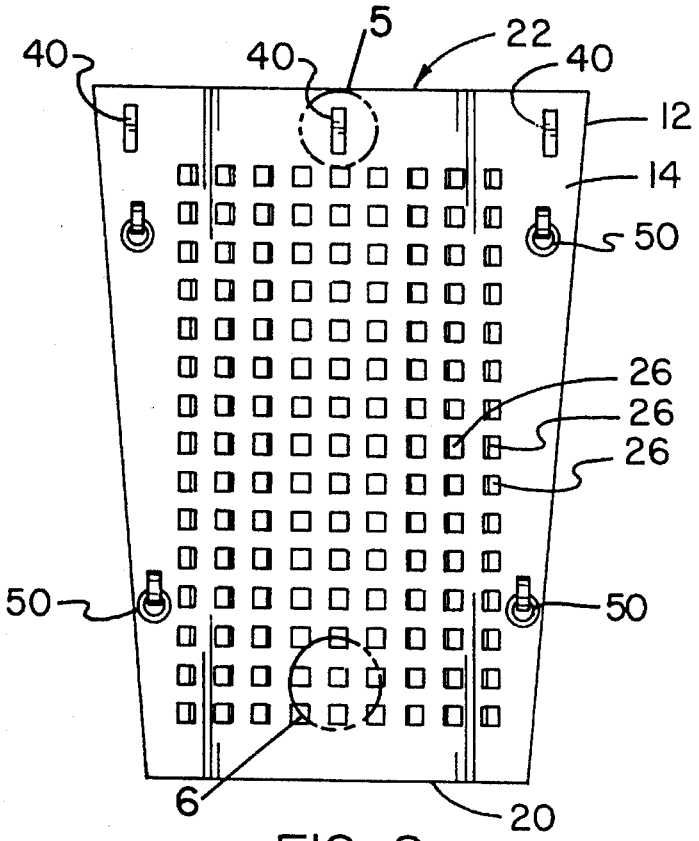
FIG. 2 is a front elevational view of the device shown in FIG. 1.
Figure 3:
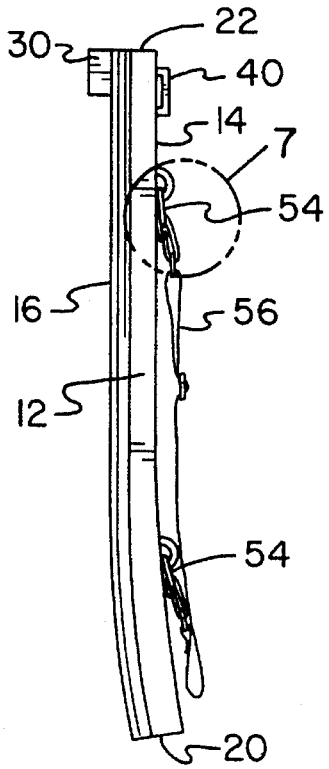
FIG. 3 is a side elevational view of the device shown in FIGS. 1 and 2.
Figure 4:
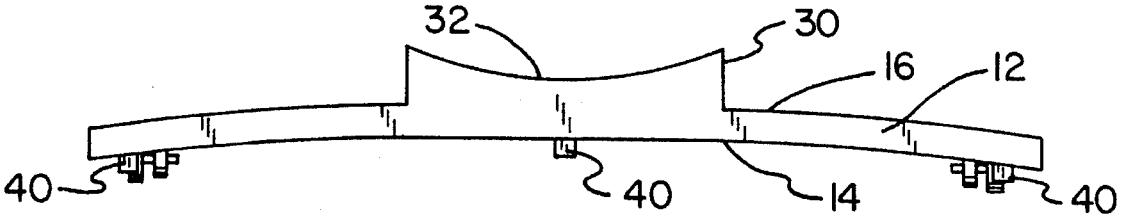
FIG. 4 is a top elevational view of the device shown in FIGS. 1, 2 and 3.
Figure 5:
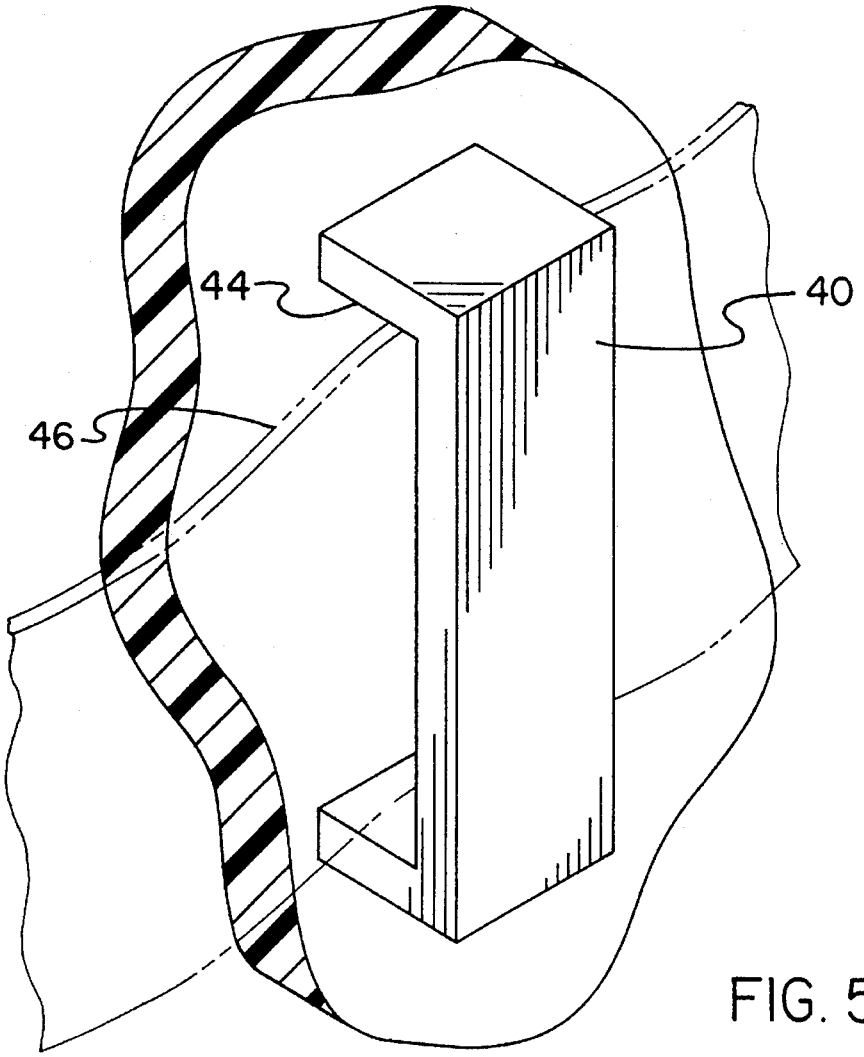
FIG. 5 is an enlarged perspective view of the belt loop taken about the circle 5 of FIG. 2.
Figure 6:
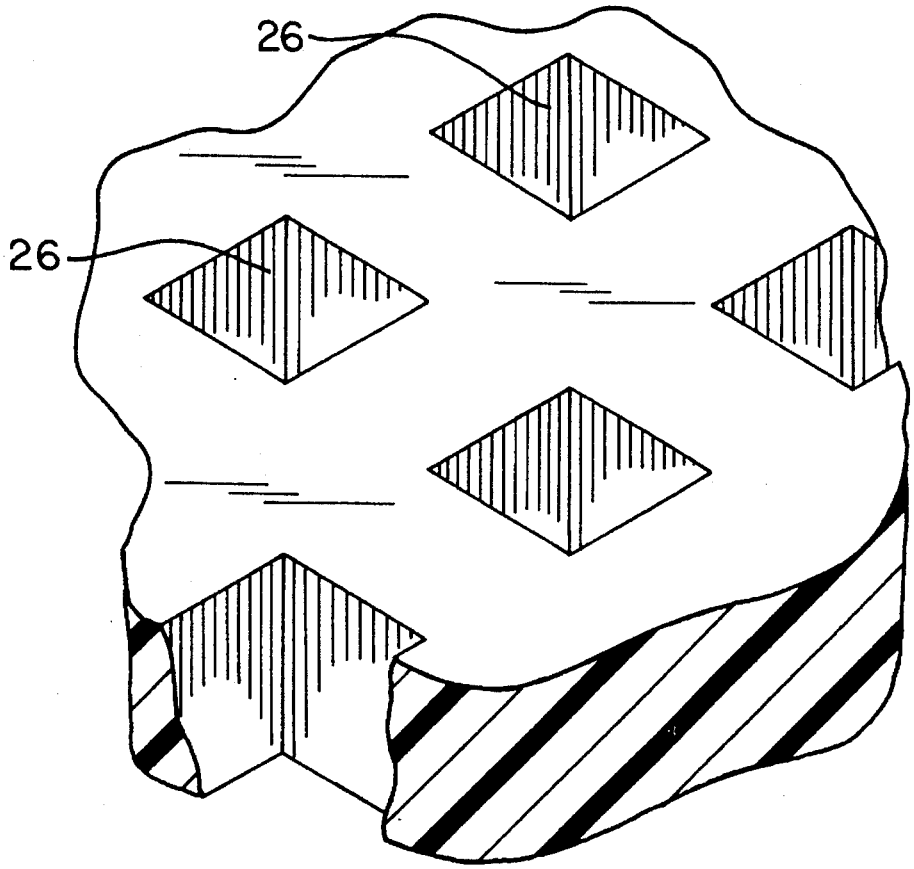
FIG. 6 is an enlarged perspective view of the apertures in the device taken about circle 6 of FIG. 5.
Figure 7:
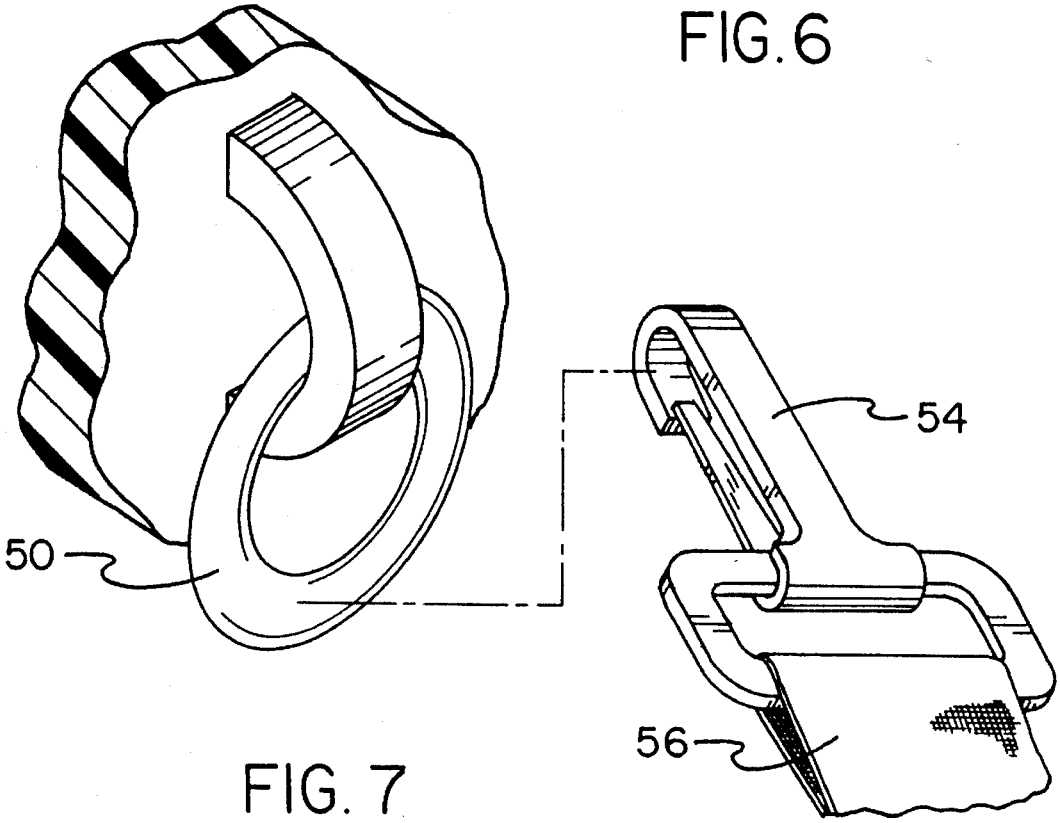
FIG. 7 is an exploded perspective view of the coupling mechanisms taken about circle 7 of FIG. 3.

With reference now to the drawings, and in particular to FIG. 1 thereof, a new and improved back rest for use in resting against a tree embodying the principles and concepts of the present invention and generally designated by the reference numeral 10 will be described.

The present invention, the new and improved back rest for resting against a tree is a system 10 comprised of a plurality of components such components include, in their simplist terms, a pad, belt loops, eyelets and shoulder straps.

The central component of the system 10 of the present invention is a pad 12. The pad is of a generally trapazoidal configuration. It has a front face 14 and a rear face 16. It is fabricated of a resilient elastomeric material.

The pad is about 24 inches in height. It is about thirteen inches wide in width at its bottom edge 20 and about 17 inches in width at its top edge 22. These dimensions are approximate and could be about plus or minus 20 percent and still attain the desired objectives.

The pad is formed with a plurality of apertures 26 in rows and columns throughout the majority of its extent. The apertures are preferrably rectangular in configuration.

A projection 30 extends rearwardly from the rear face of the device. Such projection is adjacent to the top edge of the pad. The projection has a concave surface 32 adapted to be received by the convex surface 34 of a tree 36 against which the pad is positioned. The projection is preferably located in a central extent of the pad for about ⅓ of the width, between about 20 and 45 percent of the width is acceptable.

Next provided are a plurality of belt loops 40. Such belt loops 42 are formed adjacent to the top edge of the device. The loops have holes 44 in axially alignment. Such holes of the loops are for being supported on the belt 46 of a user.

A plurality of eyelets 50 are then secured with respect to the front face of the pad. The eyelets are preferrably positioned adjacent to the four corners of the pad and function in moveable securing the pad to the user.

Such hooks are for securement with the vertically aligned eyelets. Each strap also has an adjusting component intermediate its end for varying the size of the shoulder straps and, consequently, the device, with respect to the size of the user.

The present invention is used to support the back when seated by a tree. When in the woods, hunters or hikers often stop to rest. Frequently they just lean back against the tree trunk, but that is uncomfortable and causes the back to become itchy. During and after foul weather, the trunk can be damp which adds to the discomfort. Ordinarily pads can be carried into the woods and used as back rests, but this is a cumbersome and the pads can become wet and damaged. It is much easier to use one that is specifically designed for this purpose.

The present invention is easy to transport and lightweight. It is made of plastic and is molded with a cylindrical contour on the back to fit against a tree trunk. It is about 17 inches wide and 24 inches long, in the shape of a trapezoid, and is ergonomically curved to make it comfortable to lean against. The material has a square perforations for circulation of air and for weight reduction. It has eyelets at the outer edges for the shoulder strap rings. The shoulder straps allow to rest to be carried like a knapsack and are made of heavy nylon webbing. Eyelets are also provided at the top for attaching it to a belt. The present invention comes in sizes for children as well as adults, and both are available in fluorescent orange and camouflage patterns.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved back rest for use in resting against a tree comprising, in combination:

a pad of a generally trapezoidal configuration with a front face and a rear face and formed of a resilient elastomeric material, the pad being about 24 inches in height, about 13 inches in width at its bottom edge, and, about 17 inches in width at its top edge, the pad having a plurality of rectangular apertures in rows and columns throughout the majority of its extent, a projection extending rearwardly from the rear face of the pad adjacent to its top edge, the projection having a concave surface adapted to be received by the convex surface of a tree against which the pad is positioned.

a plurality of belt loops formed adjacent to the top edge of the device with the holes of the loops in axially alignment for being supported on the belt of a user;

a plurality of eyelets secured with respect to the front face of the pad, the eyelets being positioned adjacent to the four corners of the pad; and a pair of shoulder straps, each shoulder strap having a hook at its opposite ends for securement with vertically aligned eyelets of the pad, each strap having an adjustment means intermediate its end.

2. A back rest for use in resting against a tree comprising:

a pad of a generally trapezoidal configuration with a front face and a rear face and formed of a resilient elastomeric material, the pad being wider at its top edge than its bottom edge, the pad having a plurality of apertures in rows and columns throughout the majority of its extent, a projection extending rearwardly from the rear face of the pad adjacent to its top edge, the projection having a concave surface adapted to be received by the convex surface of a tree against which the pad is positioned and a plurality of belt loops formed adjacent to the top edge of the device with the holes of the loops in axially alignment for being supported on the belt of a user;

3. The back rest as set forth in claim 2, and further including a plurality of eyelets secured with respect to the front face of the pad, the eyelets being positioned adjacent to the four corners of the pad; and a pair of shoulder straps, each shoulder strap having a hook at its opposite ends for securement with vertically aligned eyelets of the pad, each strap having an adjustment means intermediate its end.

4. The back rest as set forth in claim 2, and further including;

a pair of shoulder straps, each strap having a pair of shoulder straps, each shoulder strap having a hook at its opposite ends for securement with vertically aligned eyelets of the pad, each strap having an adjustment means intermediate its end.

* * * * *